United States Patent [19]

Foss et al.

[11] Patent Number: 4,572,846

[45] Date of Patent: Feb. 25, 1986

[54] METHOD OF HERMETICALLY SEALING ELECTRONIC PACKAGES

[75] Inventors: Robert M. Foss; Gerald R. Severson, both of Scottsdale, Ariz.

[73] Assignee: Motorola, Inc., Schaumburg, Ill.

[21] Appl. No.: 553,011

[22] Filed: Nov. 18, 1983

[51] Int. Cl.[4] ..... B05D 7/22

[52] U.S. Cl. ..... 427/237; 427/238; 427/255.6

[58] Field of Search ..... 427/237, 238, 282, 300, 427/255.6

[56] References Cited

U.S. PATENT DOCUMENTS

| | | | |
|---|---|---|---|
| Re. 30,658 | 6/1981 | Arvidsson | 118/427 |
| 1,581,401 | 4/1926 | Mueller | 427/237 |
| 3,379,803 | 4/1968 | Tittmann et al. | 427/255.6 |
| 3,753,766 | 8/1973 | Brown et al. | 118/306 |
| 3,810,441 | 5/1974 | Padgett et al. | 118/306 |
| 3,989,006 | 11/1976 | Estebanez et al. | 118/306 |
| 4,042,727 | 8/1977 | Henderson et al. | 427/237 |
| 4,081,574 | 3/1978 | Hawkins et al. | 427/237 |
| 4,148,275 | 4/1979 | Benden et al. | 427/237 |
| 4,289,091 | 9/1981 | Warner | 118/642 |

*Primary Examiner*—Sadie L. Childs

*Attorney, Agent, or Firm*—Jonathan P. Meyer

[57] ABSTRACT

Electronic packages and the like, particularly finished packages with leaky welds, are hermetically sealed by vapor deposition of a polymer film through a sealable port. A high quality film is obtained by slow deposition of a monomer vapor which subsequently polymerizes. The process is not destructive due to the lack of high temperatures and curing agents. Extremely low permeability for common molecules and for water vapor is achieved by utilizing C-type para-xylylene as the polymer material.

7 Claims, 1 Drawing Figure

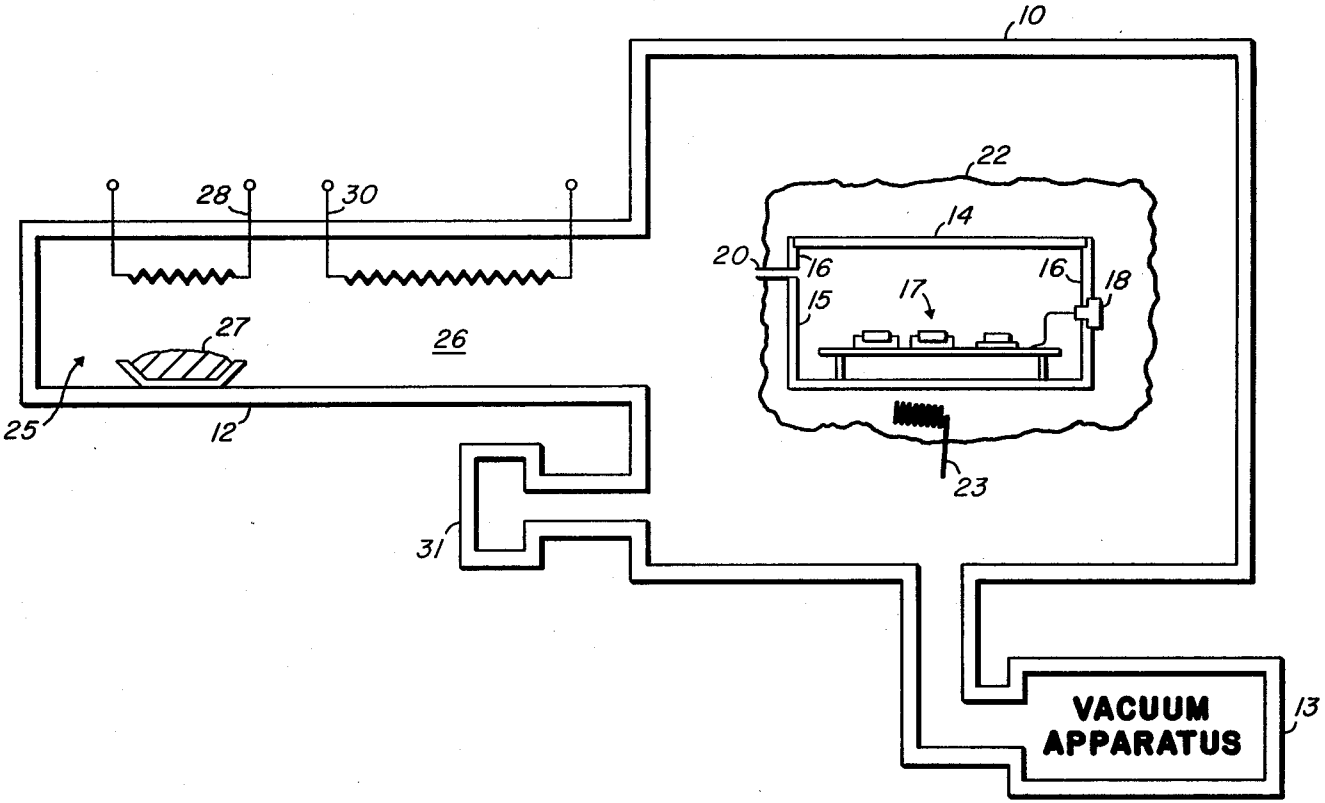
VACUUM APPARATUS
10
12
13
14
15
16
16
17
18
20
22
23
25
26
27
28
30
31

METHOD OF HERMETICALLY SEALING ELECTRONIC PACKAGES

FIELD OF THE INVENTION

The present invention relates, in general, to hermetically sealed packages for electronic components and the like. More particularly, the invention relates to a method for hermetically sealing electronic packages by vapor deposition of a polymeric material inside the packages.

BACKGROUND OF THE INVENTION

One method of improving the lifetime of electronic devices and circuits, especially in harsh environments, is to seal them inside a package. When the package is designed so that the rate of leakage of certain molecules into the package is less than a certain very low rate, the package is said to be hermetically sealed.

Many methods of producing hermetically sealed packages are known. A very common method involves the use very high quality welds which have inherently low leak rates. In practice however, a sufficiently large number of such welds require rewelding due to high leak rates that the overall cost of the process is high. Several methods of sealing involving spraying, brushing or dipping with a liquid material which is subsequently cured are also known. However, applying these methods to the improvement of an existing weld requires the maintenance of a pressure differential to impregnate the weld and does not result in as low a leak rate as might be desired. In addition, prior art methods often require high temperatures and/or harsh curing compounds which may damage electronic components within the package.

SUMMARY OF THE INVENTION

Accordingly, it is an object of the present invention to provide an improved, hermetically sealed package for electronic components and the like.

A further object of the present invention is to provide an improved method of hermetically sealing packages of electronic components and the like.

Yet a further object of the present invention is to provide a method of hermetically sealing electronic packages which is suitable for improving the leak rates of existing welds.

A particular embodiment of the present invention comprises a method of vapor deposition of a para-xylylene material through an aperture in an electronic package. The para-xylylene is vaporized through the application of heat to the dimer powder form, is pyrolyzed to the monomer form and is introduced into a deposition chamber from which it diffuses into the package through the aperture. The monomer vapor condenses onto the inside of the package and polymerizes, eventually forming a continuous film.

The vaporized para-xylylene provides excellent penetration and coverage even through a relatively small aperture, thus making possible the sealing of previously closed but leaky packages with minimum disturbance. The resulting film provide extremely low leak rates for common molecules and is also an excellent water vapor barrier. These and other objects and advantages of the present invention will be apparent to one skilled in the art from the detailed description below taken together with the drawing.

BRIEF DESCRIPTION OF THE DRAWING

The single FIGURE is a cross-sectional view of an apparatus for hermetically sealing packages according to the principles of the present invention.

DETAILED DESCRIPTION OF THE INVENTION

The single drawing FIGURE represents a somewhat simplified sectional view of an apparatus for hermetically sealing electronic packages and the like by vapor deposition of a polymer layer. In general, the apparatus comprises a deposition chamber 10, a vapor supply tube 12 and a vacuum apparatus 13. An electronic package 14 is disposed within deposition chamber 10. Package 14 typically comprises a metal container 15 which has been partially sealed by welds 16. Electronic components 17 are disposed within container 15 and are connected to the outside world via connector 18. A sealable port 20 in one wall of container 15 provides access to the interior of container 15, for instance for the purposes of testing the hermeticity of welds 16. Commonly, sealable port 20 is threaded to accommodate a screw with an O-ring seal. Port 20 may also be sealed by means of solder or other methods.

In a preferred embodiment of the present invention, electronic package 14 is disposed in chamber 10 and enclosed in a polyethylene envelope 22. Envelope 22 is attached to port 20 so that vapors may enter the interior of container 15, but are not deposited on the outside thereof. However, if the deposition of a polymer film on the outside of package 14 is desired, envelope 22 may be omitted. If envelope 22 is used, it is necessary to provide means for equalizing the pressure on either side thereof without allowing the entrance of vapor. A flexible, coiled tube 23 approximately 10 inches long is used for this purpose. It has been found that tubing with an inside diameter of approximately 0.062 inches provides a sufficient barrier to passage of the vaporized material. The combination of the length and diameter of the tube prevents the diffusion of vapor inside envelope 22.

Once electronic package 14 is sealed within deposition chamber 10, vacuum apparatus 13 is used to reduce the pressure within deposition chamber 10 and vapor supply tube 12 to a predetermined level. As is discussed more fully below, the pressure within deposition chamber 10 is chosen in view of the desired deposition rate of the polymer film. Once the desired pressure is reached, it may be advantageous to hold that pressure from some period of time prior to beginning deposition to insure the removal of all volatiles from the system.

Vapor supply tube 12 comprises a vaporization zone 25 and a pyrolysis zone 26. A predetermined amount of material 27, which is to produce the vapor, is placed in vaporization zone 25. In a preferred embodiment of the present invention material 27 is para-xylylene which is a dimer in the powder form. The preferred type of material is the C-type, or poly-monochloro-para-xylylene. Details of the preparation and deposition of material of this type are disclosed in U.S. Pat. Nos. 3,288,728 and 3,342,754. This type is chosen for its superior gas permeability. A heating device 28 in vaporization zone 25 of vapor supply tube 12 is used to raise the local temperature to a level sufficient to vaporize material 27. In the case of the preferred embodiment, a vaporizer temperature of 170° C. is sufficient.

The dimer vapor produced in vaporizer section 25 proceeds to pyrolysis zone 26. At this point a heating device 30 raises the local temperature to a level sufficient to alter the vapor to the monomer form. In the preferred embodiment, the pyrolysis temperature is approximately 695° C.

After undergoing pyrolysis, the vapor enters deposition chamber 10 and begins to cool. A portion of the vapor enters port 20 of electronic package 14 and condenses on the relatively cool walls thereof. As this process proceeds, a void free continuous film is formed on all surfaces inside package 14. Any small leaks which existed prior to deposition of such film, such as in welds 16 or around connector 18 are sealed. As the film is deposited, the material polymerizes.

In some applications, such as packages which are to be subjected to substantial vibration, it is desirable to promote the adhesion of the film to interior surfaces of package 14. To this end, an auxiliary vaporization chamber 31 attached to deposition chamber 10 is charged with a silane adhesion promoter. The adhesion promoter is vaporized by the application of heat and enters chamber 10 where it coats all surfaces which are to be later coated with the polymer film.

As is apparent to one skilled in the art, the rate at which powder material 27 is vaporized, pyrolyzed, and deposited is primarily determined by the pressure maintained in deposition chamber 10 by vacuum apparatus 13. In a preferred embodiment, the measured chamber of pressure is approximately 56 microns of mercury. It is found that this results in a consumption of material 27 of approximately 0.137 grams per minute. This low throughput rate allows the vaporized monomer to adequately diffuse into the package. A typical process run at the preferred rate requires approximately nine hours to complete. A number of variations in the process parameters are possible as long as the deposition rate is low enough to be consistent with a high quality film. Many of these parameters are, to some degree, equipment dependent.

As is apparent, the present invention provides a method for hermetically sealing electronic packages and the like which is suitable for application to otherwise finished packages. This is due to the fact that the vapor which eventually forms the film is able to diffuse into the interior of the package through a relatively small sealable port. In addition, no harsh catalysts, curing agents or high temperature cycles are required which might damage delicate electronic components.

While the present invention has been particularly shown and described with reference to a preferred embodiment thereof, various modifications and changes to the invention will be apparent to one skilled in the art and may be made without departing from the spirit and scope of the present invention; accordingly, it is intended to include such modifications and changes within the scope of the appended claims.

We claim:

1. A method of hermetically sealing an electronic package comprising the steps of:

providing a sealable port in said package;

introducing a monomer vapor into said package through said port; and condensing said monomer vapor at least on an interior of said package, whereby a polymer film is formed.

2. A method aceording to claim 1 further comprising the step of:

protecting an outside of said package from condensation of said monomer vapor.

3. A method according to claim 1 wherein said monomer vapor is para-xylylene.

4. A method of hermetically sealing an electronic package comprising the steps of:

providing a sealable port in said package;

disposing said package in a deposition chamber at a predetermined reduced pressure;

vaporizing a dimer material;

pyrolyzing said vaporized dimer to form a monomer vapor;

introducing said monomer vapor into said deposition chamber;

condensing said monomer vapor at least on an interior of said package, whereby a polymer film is formed; and sealing said sealable port.

5. A method according to claim 4 further comprising the step of:

enclosing said package, exclusive of said sealable port, in an envelope to prohibit condensation of said vapor on an outside of said package, said envelope including pressure equalization means.

6. A method according to claim 4 wherein said predetermined reduced pressure is chosen so that a rate at which said dimer material is consumed is substantially less than 1 gram per minute.

7. A method according to claim 4 wherein said dimer material is parylene powder.

* * * * *